US008016357B2

(12) United States Patent
Figueras Mitjans

(10) Patent No.: US 8,016,357 B2
(45) Date of Patent: Sep. 13, 2011

(54) AUTOMATIC ROTATION SYSTEM FOR TILTING SEATS OF CHAIRS OR ARMCHAIRS

(75) Inventor: Jose Figueras Mitjans, Barcelona (ES)

(73) Assignee: Figueras International Seating, S.A., Barcelona (ES)

( * ) Notice: Subject to any disclaimer, the term of this patent is extended or adjusted under 35 U.S.C. 154(b) by 41 days.

(21) Appl. No.: 12/448,606

(22) PCT Filed: Dec. 27, 2007

(86) PCT No.: PCT/ES2007/000763

§ 371 (c)(1), (2), (4) Date: Jun. 26, 2009

(87) PCT Pub. No.: WO2008/077979

PCT Pub. Date: Jul. 3, 2008

(65) Prior Publication Data

US 2009/0315377 A1 Dec. 24, 2009

(30) Foreign Application Priority Data

Dec. 27, 2006 (ES) ..... 200603269

(51) Int. Cl.
*B60N 2/20* (2006.01)
*B60N 2/22* (2006.01)

(52) U.S. Cl. ..... 297/374; 297/361.1; 192/223.2; 192/223.3; 192/223.4

(58) Field of Classification Search ..... 297/354.1, 297/354.12, 361.1, 364, 374
See application file for complete search history.

(56) References Cited

U.S. PATENT DOCUMENTS

| | | | | |
|---|---|---|---|---|
| 2,066,167 | A * | 12/1936 | Swartz | 192/223.2 |
| 2,145,666 | A * | 1/1939 | Roethel | 192/223.3 |
| 2,465,630 | A | 3/1949 | Howard et al. | |
| 3,098,677 | A | 7/1963 | Williams et al. | |
| 4,070,058 | A * | 1/1978 | Muehling | 297/374 |
| 4,614,257 | A * | 9/1986 | Harada et al. | 192/223.4 |
| 4,651,854 | A * | 3/1987 | Harada | 192/223.4 |
| 4,786,110 | A * | 11/1988 | Mahling et al. | 297/362 |
| 5,794,479 | A * | 8/1998 | Schwarzbich | 74/143 |
| 6,273,233 | B1 * | 8/2001 | Denis | 192/223.2 |
| 6,481,557 | B2 * | 11/2002 | Denis | 192/223.2 |
| 6,508,347 | B1 * | 1/2003 | Hochmuth | 297/362 X |
| 6,637,575 | B2 * | 10/2003 | Liu et al. | 192/223.2 |
| 6,640,952 | B2 * | 11/2003 | Baloche et al. | 192/223.2 |
| 6,641,215 | B2 * | 11/2003 | Rohee | 297/374 X |
| 6,688,443 | B2 * | 2/2004 | Liu | 192/15 |
| 6,691,851 | B2 * | 2/2004 | Liu et al. | 192/223.2 |
| 6,702,089 | B1 * | 3/2004 | Scheck et al. | 192/223 |
| 6,860,374 | B2 * | 3/2005 | Liu et al. | 192/223.2 |

(Continued)

FOREIGN PATENT DOCUMENTS

GB 224687 A 11/1924

(Continued)

*Primary Examiner* — Rodney B White
(74) *Attorney, Agent, or Firm* — The Nath Law Group; Jerald L. Meyer; Sung Yeop Chung

(57) ABSTRACT

Disclosed is an automatic rotation system for tilting seats of chairs or armchairs, comprising a seat fastener having at least one holder formed by first and second parts rotatably coupled together; first and second conformations respectively attached to the first and second rotatably coupled seat fastener parts; and a spring incorporated between the first and second rotatably coupled seat fastener parts.

6 Claims, 3 Drawing Sheets

U.S. PATENT DOCUMENTS

| | | | | |
|---|---|---|---|---|
| 6,945,600 | B2 * | 9/2005 | Liu | 297/284.4 |
| 6,951,270 | B2 * | 10/2005 | Liu | 192/223.2 |
| 7,051,860 | B2 * | 5/2006 | Scheck et al. | 297/374 X |
| 7,651,164 | B2 * | 1/2010 | Garnier et al. | 297/344.12 |
| 2004/0174061 | A1 * | 9/2004 | Scheck et al. | 297/374 |

FOREIGN PATENT DOCUMENTS

| | | | |
|---|---|---|---|
| GB | 235586 | A | 3/1926 |
| GB | 2189682 | A | 11/1987 |

* cited by examiner

AUTOMATIC ROTATION SYSTEM FOR TILTING SEATS OF CHAIRS OR ARMCHAIRS

FIELD OF THE ART

The present invention relates to the chairs or armchairs having a seat which can be tilted between a lowered use position and a raised folded position, proposing an automatic rotation system for tilting the mentioned seats, with a braking action preventing the blow of the seat when it is taken by the action of a spring to the folded position.

STATE OF THE ART

There is furniture, in chair and armchair formats, the seat of which is arranged in a rotation assembly allowing the tilt between a lowered use position and a raised folded position, solutions being known in which said assembly of the tilting seats includes a spring acting in the direction of taking the seat to the raised folded position, thus determining an automatic actuation for raising the seat to said folded position when it is left free.

The known solutions of said automatic arrangement of action of the tilting seats towards the raised folded position include a torsion spring which is arranged tensed between respective parts which can rotate in relation to one another, of the rotating assembly of the seat.

This arrangement of the rotation of the seats with a tensed torsion spring has the drawback that the action of the spring is completely free and causes the tilting movement of the seat with acceleration in the rise, which gives rise to a blow occurring abruptly when the seat reaches the stop of the raised position, causing noise and, with the successive actuations there may be, for this reason, maladjustments of the actual structure of the chair or armchair in application.

To reduce this problem of the blow of the seats in the automatic tilt of the folding, the adjustment of the tension of the actuating spring is played with, it being complicated to perform said adjustment, and if the tension of the spring is reduced too much, the rise of the seat is slow and may not have the necessary effectiveness.

OBJECT OF THE INVENTION

According to the invention, an assembly of the rotation system for tilting seats based on a simple embodiment is proposed, whereby functional advantages allowing the tilt of the seats with complete effectiveness are achieved, but preventing the abrupt blow in the stop of the tilt of the rise.

This system of the invention is based on arranging the seat in the assembly by means of rotation holders formed by two complementary parts associated in a rotating play between same, with limiting stops in an angular path of the rotation, one of the parts being intended to be fixed on the side structure of the chair or armchair in application, whereas the other part determines an insertion to couple the tilting seat thereon in integral rotation.

According to the invention, between the two component parts of each rotation holder there is arranged a helicoidal spring which is incorporated in traction assembly, said spring being mounted on a conformation in the form of a drum of one of the parts of the holder, on which conformation the spring exerts an embracing action with a clamping effect.

An arrangement is thus obtained in which the traction spring exerts a rotation force between the two component parts of the holder, which causes the drive for the tilt for raising the seat in application, but such that at the same time said spring exerts a braking damping the action of the rotation as a result of the friction of its coils on the conformation in the form of a drum and due to the clamping effect exerted by the actual tension of the spring on said conformation.

The rotation of the seat towards the raised folded position thus begins with a quick start due to the tension of the traction spring, but as the rise occurs, the braking effect together with the decrease of the tension of the spring make the rising movement become gradually smoother, reaching the stop of the path of the rise such that there is no abrupt blow.

The system of the invention therefore has truly advantageous features, acquiring its own identity and a preferred character in the function of the automatic rotation for folding tilting seats for which it is intended.

DETAILED DESCRIPTION OF THE INVENTION

Figure 1:
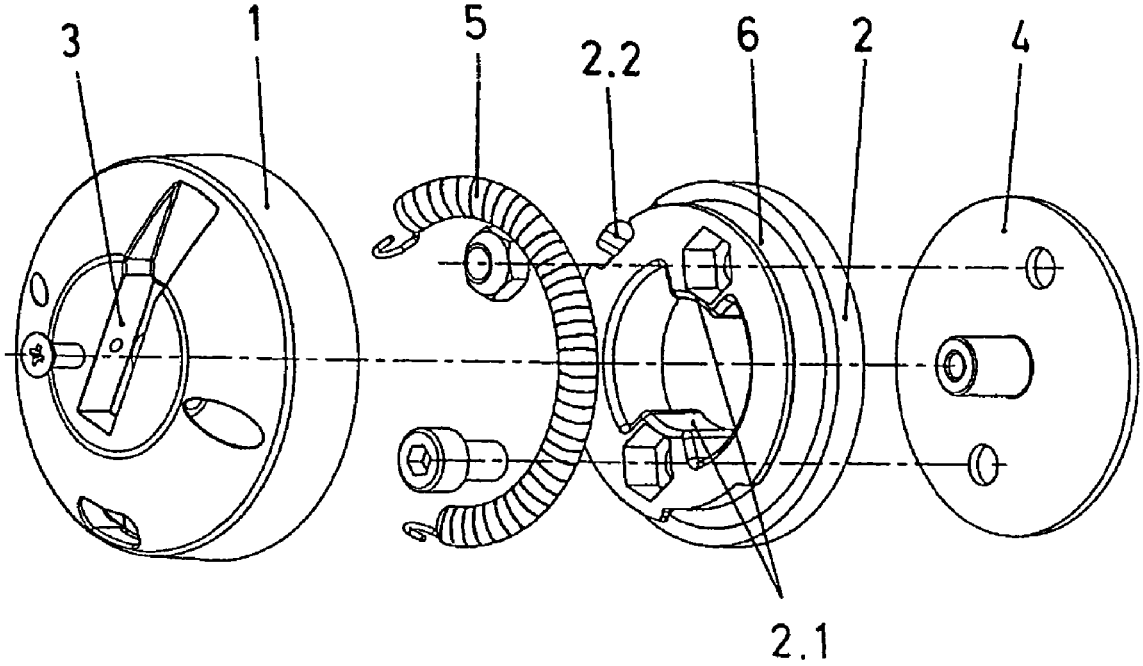
FIG. 1 shows a perspective exploded view of an embodiment of a rotation holder for tilting seats according to the invention.
Figure 2:
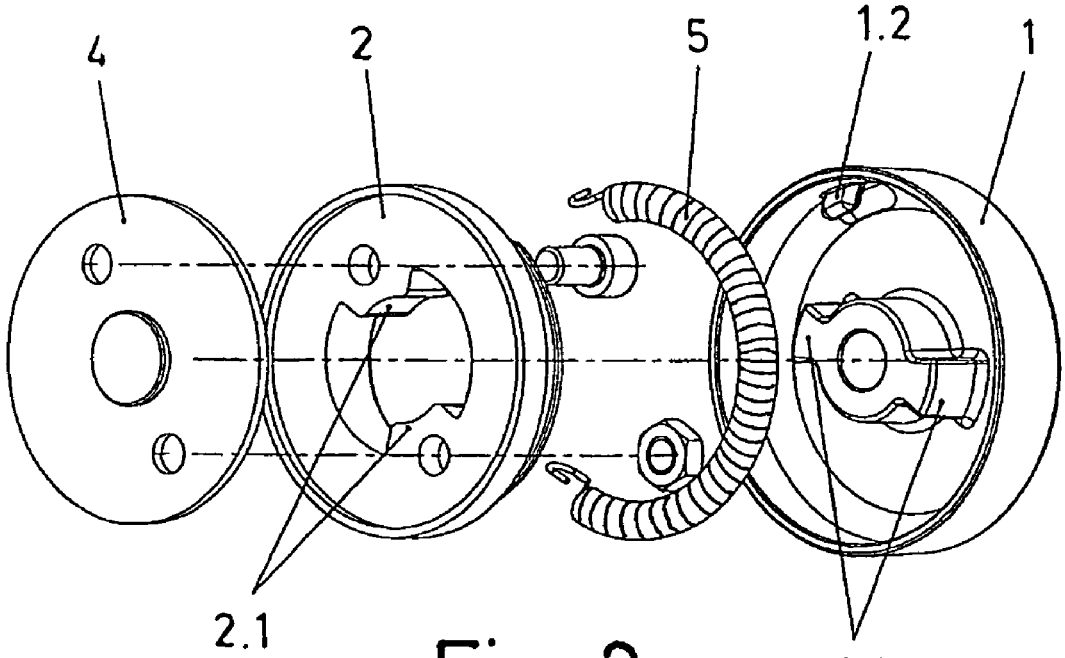
FIG. 2 is a perspective exploded view of the same previous rotation holder from another angle of observation.
Figure 3:
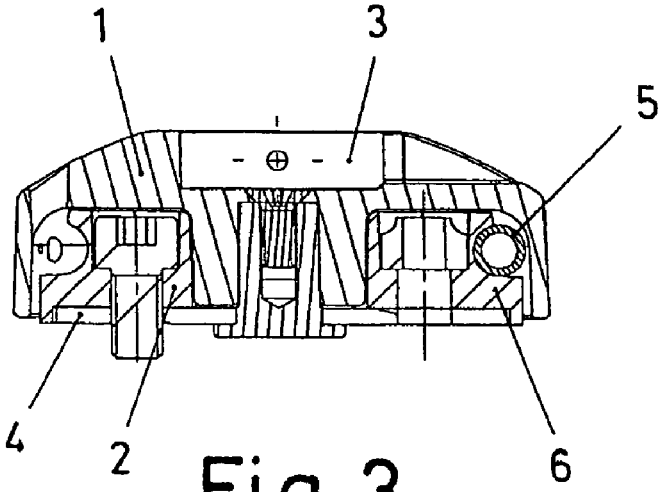
FIG. 3 is a diametric section view of the holder according to the indication III-III shown in FIG. 4.
Figure 4:
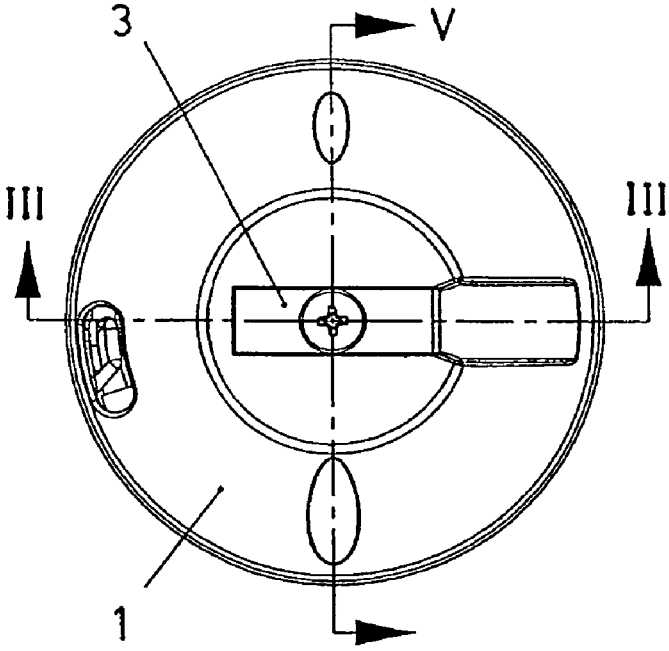
FIG. 4 is a front view of the rotation holder by the coupling part of the tilting seat.
Figure 5:
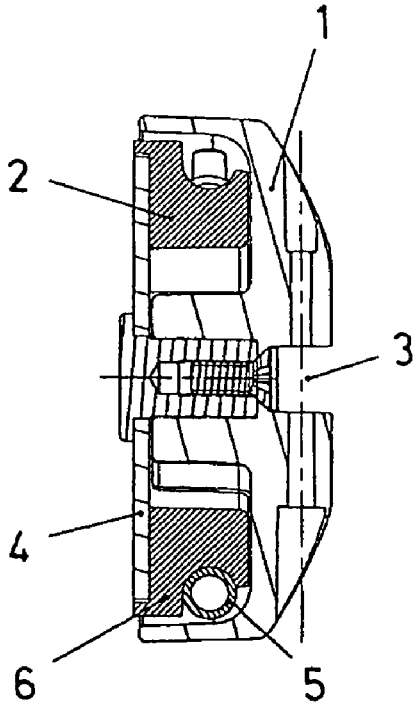
FIG. 5 is another diametric section view of the rotation holder according to the indication V-V shown in the same FIG. 4.
Figure 6:
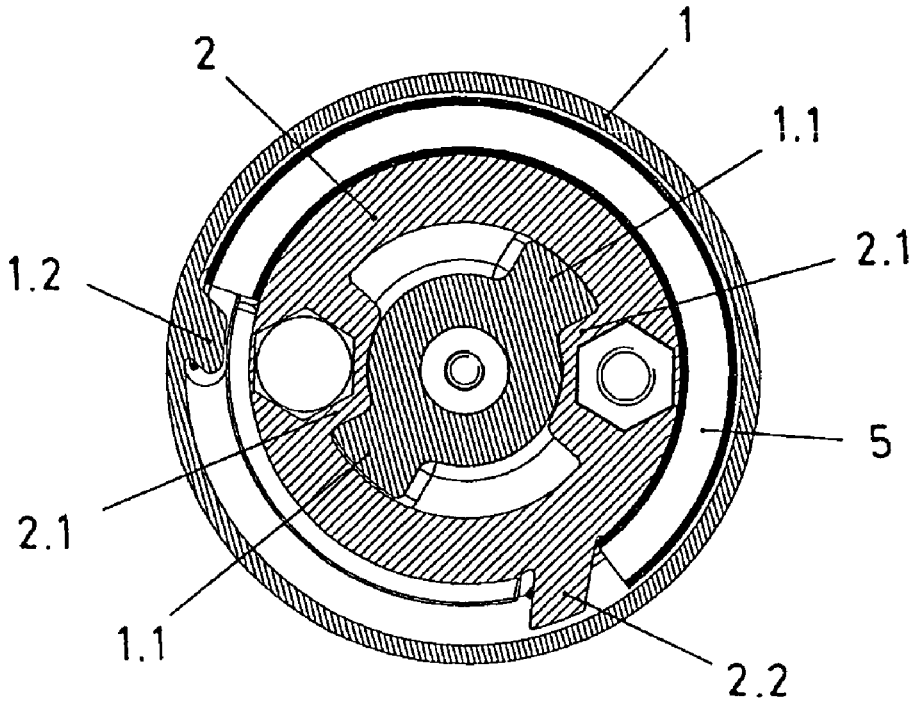
FIGS. 6 and 7 show a cross-section of the rotation holder in the two end positions of the angular path of the rotation.
Figure 7:
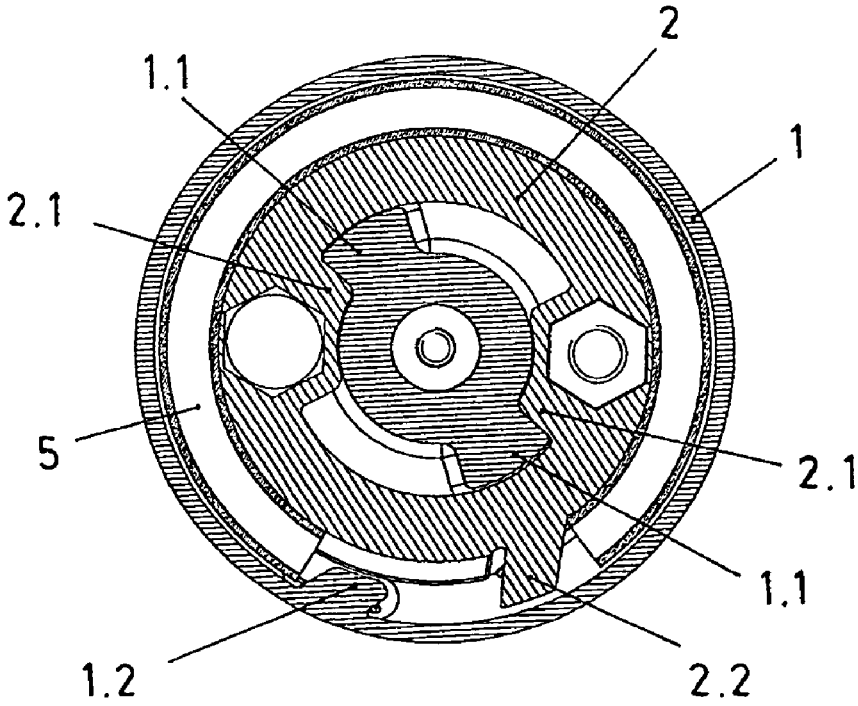

The object of the invention relates to a rotation system applicable to the assembly of the tilting seats of chairs or armchairs, with features improving the functional conditions of the tilt of said seats.

Said system is established with respect to a conventional arrangement, with the fastening of the seats in application by means of rotation holders formed by two complementary parts (1 and 2) which are coupled to one another with a relative rotation play between same.

According to a non-limiting embodiment, the component parts (1 and 2) of the holders can be made, for example, of fiberglass-reinforced polyamide, one of the parts (1) defining an insertion cavity (3) at the outer part for the coupling of the seat in application in an assembly of integral rotation with said part (1), whereas the other component part (2) of the holders is coupled to a plate (4), together with which it is fixedly fastened on the side structure of the chair or armchair in application.

The relative rotation play between the two component parts (1 and 2) of the holders is limited to a certain angle of freedom by means of limiting stops between conformations (1.1) of the component part (1) and conformations (2.1) of the component part (2), said stops coinciding with the rotation limits in the corresponding positions of the seats in application in the lowered use situation and in the raised folded situation.

According to the invention, a helicoidal type spring (5) is incorporated between the two component parts (1 and 2) of the mentioned holders of the rotating assembly of the seats, which spring is mounted on a conformation (6) in the form of an annular drum defined by one of the component parts of the holder, for example the part (2) which is fixed to the structure of the chair or armchair in application, said spring (5) being hooked by its ends with tension between respective conformations (1.2 and 2.2), in the form of lugs or pins, of the respective component parts (1 and 2) of the respective holder.

An arrangement is thus obtained in which the spring (5) has a clamping effect on the conformation (6) in the form of a drum on which it is supported, giving rise to a braking in the rotation movement between the two component parts (1 and 2) of the holder, which translates into a braking retention of the tilting movement of the seats in application, such that the rise thereof from the lowered use position when they are left free occurs with a quick initial start due to the action of the spring (5), and then the movement is gradually damped due to the braking effect, reaching the stop of the rise smoothly, preventing the abrupt blow in said stop.

The rising movement of the seats, in the mentioned conditions, is damped due to the braking effect caused by the spring (5) against the conformation (6) in the form of a drum on which it is supported, in combination with the progressive decrease of the tension of the spring (5) as the movement of the rising seat advances.

The braking effect caused by the spring (5) against the conformation (6) in the form of a drum on which it is supported occurs, if appropriate, due to the action of the tangential friction of the coils of the spring (5) on the surface of the mentioned support conformation (6), together with the clamping effect by the embracing pressure exerted by the spring (5) itself, due its tension, on the same support conformation (6).

In this sense, the surface of the mentioned conformation (6) in the form of a drum, on which the spring (5) is supported, can be provided with a finish making the friction of the spring (5) more intense to increase the braking effect.

In any case, with the same functional effect and without the concept being altered, the conformation (6) in the form of a drum for the support of the spring (5) in the assembly can be indistinctly defined in any of the two component parts (1 or 2) of the holder, and likewise, the arrangement of the rotation drive between the two parts (1 and 2) can be established with one or more springs (5) in the indicated assembly.

The invention claimed is:

1. An automatic rotation system for tilting seats of chairs or armchairs, comprising:

a seat fastener having at least one holder formed by first and second rotatably coupled parts;

first and second conformations attached to the first and second rotatably coupled seat fastener parts respectively; and a helicoidal spring incorporated between the first and second rotatably coupled seat fastener parts, the helicoidal spring being configured to elastically extend or retract along its axis according to a relative movement of the first and second rotatably coupled seat fastener parts.

2. The automatic rotation system for tilting seats of chairs or armchairs of claim 1, further comprising a traction assembly between the first and second conformations of the first and second rotatably coupled seat fastener parts.

3. The automatic rotation system for tilting seats of chairs or armchairs of claim 2, wherein the helicoidal spring is hooked by its ends in the traction assembly.

4. The automatic rotation system for tilting seats of chairs or armchairs of claim 3, further comprising:

an annular drum having a third conformation, with the drum defined by at least one of the first and second rotatably coupled seat fastener parts, wherein the helicoidal spring mounts on the third conformation.

5. The automatic rotation system for tilting seats of chairs or armchairs according to claim 4, wherein the helicoidal spring exerts an embracing pressure force on the third conformation, creating a clamping effect which gives rise to a braking action in the relative rotation movement between the first and second rotatably coupled seat fastener parts.

6. The automatic rotation system for tilting seats of chairs or armchairs according to claim 4, wherein helicoidal spring coils tangentially rub against the surface of the third conformation, exerting a friction braking force in the relative rotation movement between the first and second rotatably coupled seat fastener parts.

* * * * *